US006530631B2

(12) United States Patent
Brown

(10) Patent No.: US 6,530,631 B2
(45) Date of Patent: Mar. 11, 2003

(54) MOBILE WORKSTATION STORAGE DEVICE

(76) Inventor: Richard Paul Brown, 472 Chase Rd., North Dartmouth, MA (US) 02747

( * ) Notice: Subject to any disclaimer, the term of this patent is extended or adjusted under 35 U.S.C. 154(b) by 0 days.

(21) Appl. No.: 09/829,642

(22) Filed: Apr. 10, 2001

(65) Prior Publication Data

US 2002/0145368 A1 Oct. 10, 2002

(51) Int. Cl.[7] ..... A47B 41/06
(52) U.S. Cl. ..... 312/280; 312/233; 108/9
(58) Field of Search ..... 312/280, 281, 312/313, 325, 231, 233, 249.13, 196; 108/6, 8, 9, 10

(56) References Cited

U.S. PATENT DOCUMENTS

| | | | | | |
|---|---|---|---|---|---|
| 169,028 | A | * | 10/1875 | Nichols | |
| 1,259,436 | A | * | 3/1918 | Parks | 312/313 X |
| 2,244,036 | A | * | 6/1941 | Williman et al. | 108/9 |
| 4,040,522 | A | * | 8/1977 | Vickery | 211/88.01 |
| 4,576,424 | A | * | 3/1986 | Nelson | 312/231 |
| 5,660,117 | A | * | 8/1997 | Noble | 312/233 X |
| 6,024,427 | A | * | 2/2000 | Underwood et al. | 312/280 X |
| 6,145,800 | A | * | 11/2000 | Watkins | 248/461 |

FOREIGN PATENT DOCUMENTS

| | | | | |
|---|---|---|---|---|
| CH | 351298 | * | 4/1922 | 312/281 |

* cited by examiner

*Primary Examiner*—Janet M. Wilkens
(74) *Attorney, Agent, or Firm*—Michael I Kroll

(57) ABSTRACT

A bookcase 12 has an easel 14 pivotally attached to the back of the bookcase housing 12. The easel 14 is attached to the bookcase 12 using friction supports 16 having additional support members or hinges 24 having hinge pins 32 therein. At least one support member 16 is provided for fixedly holding the planar work surface 14 at the desired angle. Also provided is a raised edge element 26 for supporting work materials 18 upon the planar work surface 14 when in an angled position. Additionally, there is provided a centrally positioned removable rail 28 that can support additional work materials 18. The bookcase 12 has a plurality of shelves 22 mounted therein along with a plurality of casters 20 fixedly attached to its underside.

13 Claims, 8 Drawing Sheets

MOBILE WORKSTATION STORAGE DEVICE

BACKGROUND OF THE INVENTION

Field of the Invention

The present invention relates generally to bookcases and more specifically to bookcases with easels adapted to the book case housing. The purpose of the present invention is to provide an extendable retractable work surface comprised of a planar surface hingedly attached to a bookcase. The planar surface can be selectively pivoted to any desired angle, providing increased work surface. At least one support member is provided for fixedly holding the planar work surface at the desired angle. There is also provided a raised edge element to support positioned work materials while the planar work surface is in an angled position. Additionally there is provided a centrally positioned removable raised element that can support additional work materials.

The bookcase member of the present invention has a plurality of shelves, whereupon a plurality of work materials such as, publications, books, and manuals can be stored.

Located on the underside and fixedly positioned thereto is a plurality of casters whereby the present invention can be wheeled to any desired location.

In operation the planar work surface, hereinafter referred to as an easel, resides in a vertical position attached to the rear of the bookcase. By rotating the bookcase the easel can be positioned at any angle from the vertical to the horizontal. One or both of the raised transverse edge elements, hereinafter referred to as rails, can be used to support a plurality of work materials.

SUMMARY OF THE PRESENT INVENTION

The present invention discloses a bookcase having an easel pivotally attached to the back of the bookcase housing. The easel is attached to the bookcase using a pair of friction supports having additional support members or hinges having hinge pins therein. At least one support member is provided for fixedly holding the planar work surface at the desired angle. Also provided is a raised edge element for supporting work materials upon the planar work surface when in an angled position. Additionally, there is provided a centrally positioned removable rail that can support additional work materials. The bookcase has a plurality of shelves mounted therein along with a plurality of casters fixedly attached to its underside.

A primary object of the present invention is to provide a mobile storage device having a plurality of shelves and hingedly attached pivotal easel.

Another object of the present invention is to provide a mobile storage device having a plurality of wheels whereby the mobile storage device can be moved to any desired position.

Yet another object of the present invention is to provide a mobile storage device having a plurality of shelves whereupon work materials can be stored.

Still another object of the present invention is to provide a mobile storage device having an easel hingedly attached thereto.

Still yet another object of the present invention is to provide a mobile workstation storage device having a support member fixedly positioned to the easel and to the storage device.

Another object of the present invention is to provide a mobile workstation storage device having an easel that can be pivotally moved from a non-operative vertical position to an operative horizontal position.

Yet another object of the present invention is to provide a mobile workstation storage device having an easel that can be pivotally positioned to any desired angle from a vertical position to a horizontal position.

Still yet another object of the present invention is to provide a mobile workstation storage device having an easel having an edge rail for the support of work materials thereon.

Another object of the present invention is to provide a mobile workstation storage device having an easel having a removable centrally positioned rail for the support of work materials thereon.

Additional objects of the present invention will appear as the description proceeds.

The present invention overcomes the short comings of the prior art by providing a book case device used to store reference material and may be stored in an out of the way area when not in use. Also consisting an easel attached to said device by means of hinges. Also a book case and easel device that the easel portion of the device may be adjusted to any position from the vertical to the horizontal, by means of a friction device located on two sides of the book case housing. Still yet another object of the present invention is to provide a book case and easel device with a friction mechanism that controls the angular movement of the easel portion of the present invention.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
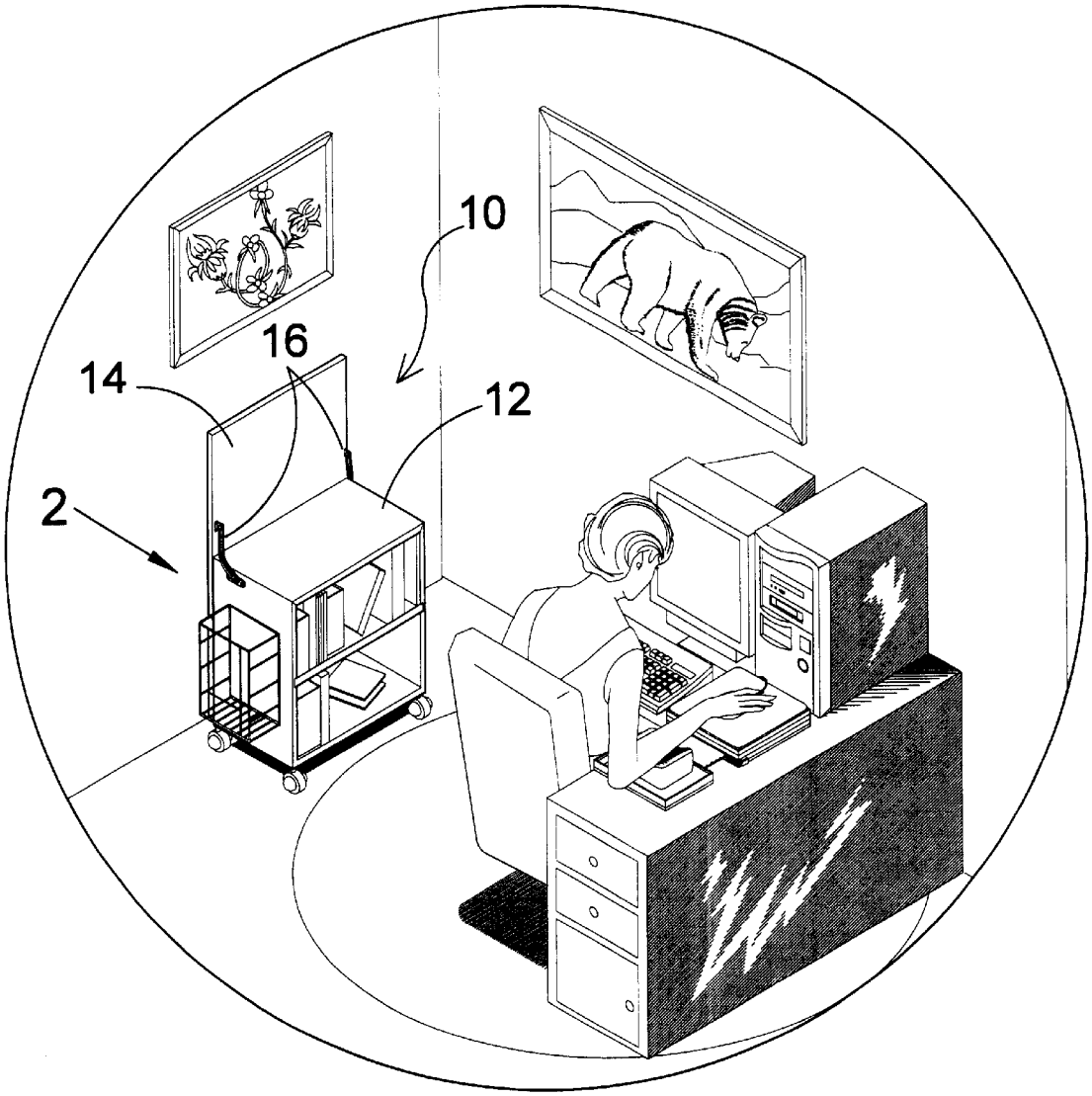
FIG. 1 is a pictorial illustration of the present invention showing the mobile workstation storage device in use.

With regard to reference numerals used, the following numbering is used throughout the drawings.

10 present invention
12 bookcase
14 easel
16 friction support
18 work articles
20 casters
22 shelf
24 hinge
26 edge rail
28 central rail
30 arrows
32 hinge pin
34 means of attachment
36 slot
38 means of attachment
40 means of attachment
42 means of attachment
44 books
46 storage basket

DESCRIPTION OF THE PREFERRED EMBODIMENT(S)

In order that the invention may be more fully understood, it will now be described, by way of example, with reference to the accompanying drawings in which FIGS. 1 through 8 illustrate the present invention being a mobile workstation storage device.

Turning to FIG. 1, shown therein is a pictorial illustration of the present invention 10 showing the mobile workstation storage device in use. Shown is the bookcase portion 12 along with the upper adjustable easel element 14 having a pair of friction lid supports 16 disposed on opposite edges of the easel 14 thereby providing support for attachment of the easel 14 to the sides of bookcase 12.

Figure 2:
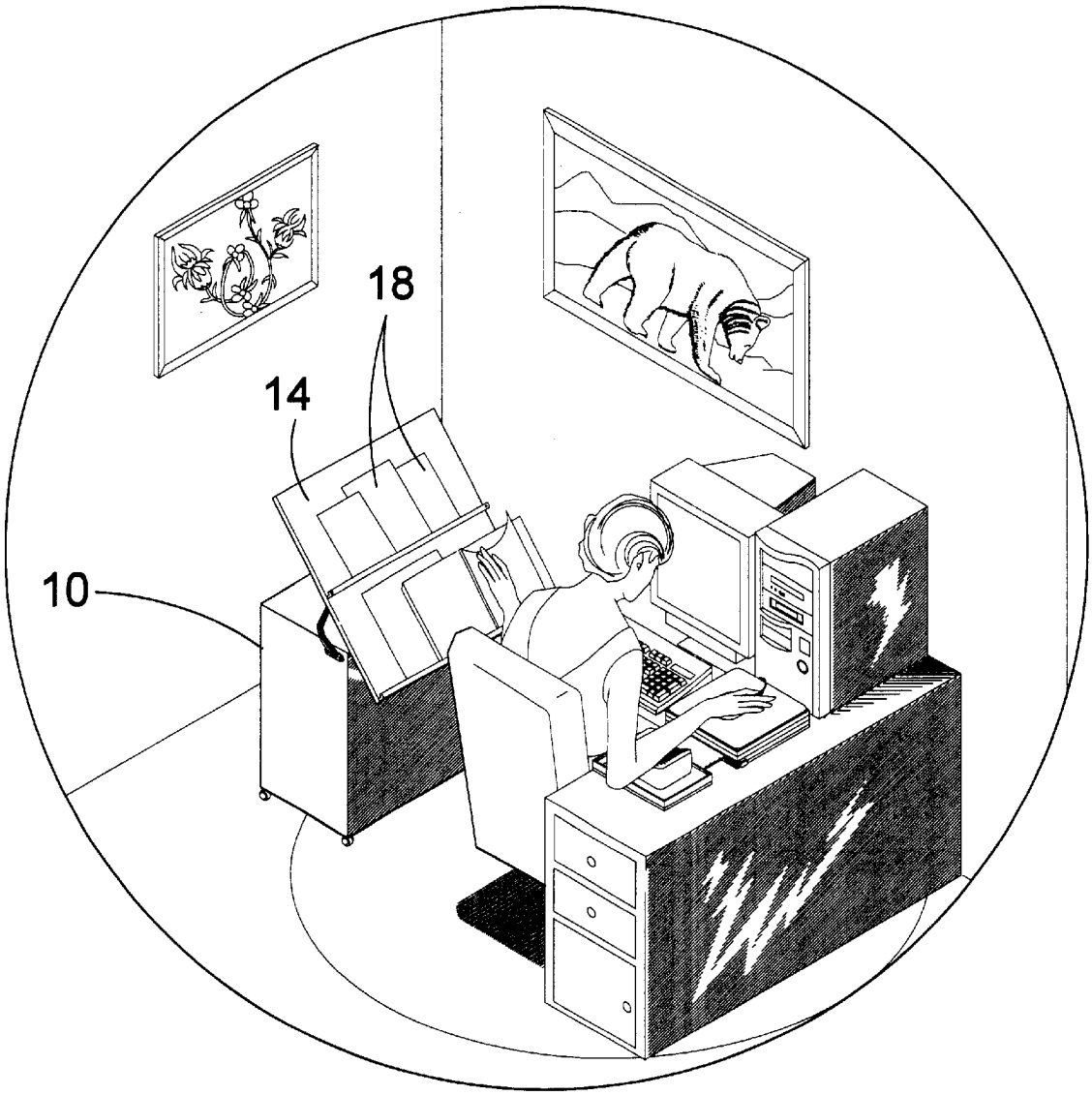
FIG. 2 is a pictorial illustration of the mobile workstation storage device in use. Shown is the unit having been rotated and the easel pivotally rotated to a desired angle.

Turning to FIG. 2, shown therein is a pictorial illustration of the mobile workstation storage device 10 in use. Shown is the easel 14 pivotally rotated to a desired angle having work articles 18 disposed thereon.

Figure 3:
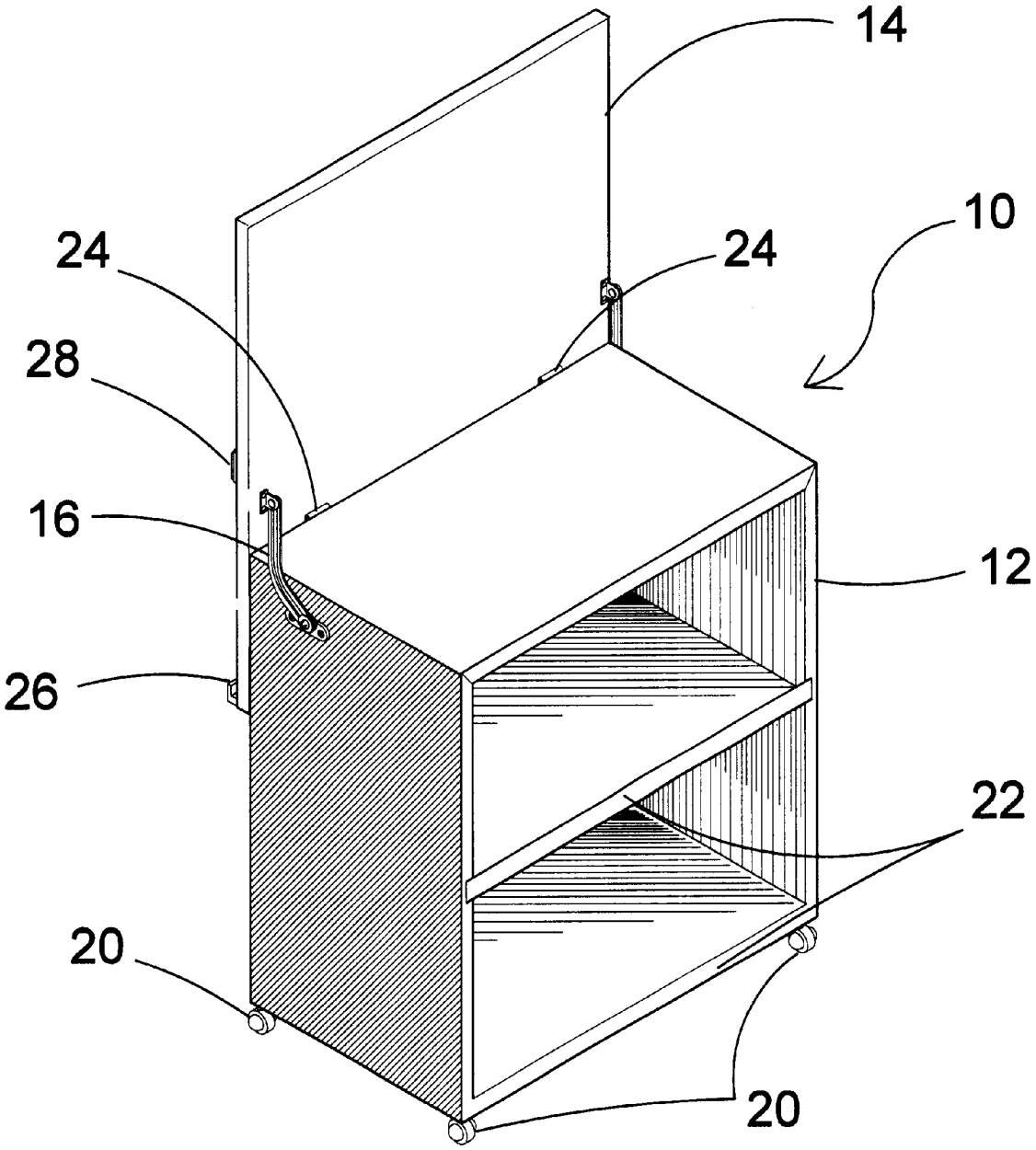
FIG. 3 is a front perspective view of the present invention. Shown is a bookcase with a plurality of casters and shelves with the easel in the stored position.

Turning to FIG. 3, shown therein is a front perspective view of the present invention 10. Shown is a bookcase 12 with a plurality of casters or wheels 20 and horizontal shelves 22 with the easel 14 in the upright or stored position. Also shown are multiple hinges 24 which connect and support the easel 14 to the upper back of bookcase 12 along with the pair of curved elongated friction lid supports or braces 16 on each side of the easel 14 along with a raised edge rail element 26 which supports positioned work materials while planar work surface of the easel 14 is at an angled position. Also shown is a centrally disposed rail 28 so that the raised rail element can support additional materials. The bookcase member 12 of the present invention has a plurality of shelves 22 whereupon a plurality of work materials such as publications, books and manuals can be stored. Located on the underside of bookcase 12 and fixedly positioned thereto are a plurality of casters 20 whereby the present invention can be wheeled to any desired location. In operation the planar work surface 14, hereinafter referred to as an easel, resides in a vertical upright position attached to the rear of the bookcase 12. By rotating the easel, it can be positioned at any angle from the vertical to the horizontal. One or both of the raised transverse edge elements 26, 28, hereinafter referred to as rails, can be used to support a plurality of work materials.

Figure 4:
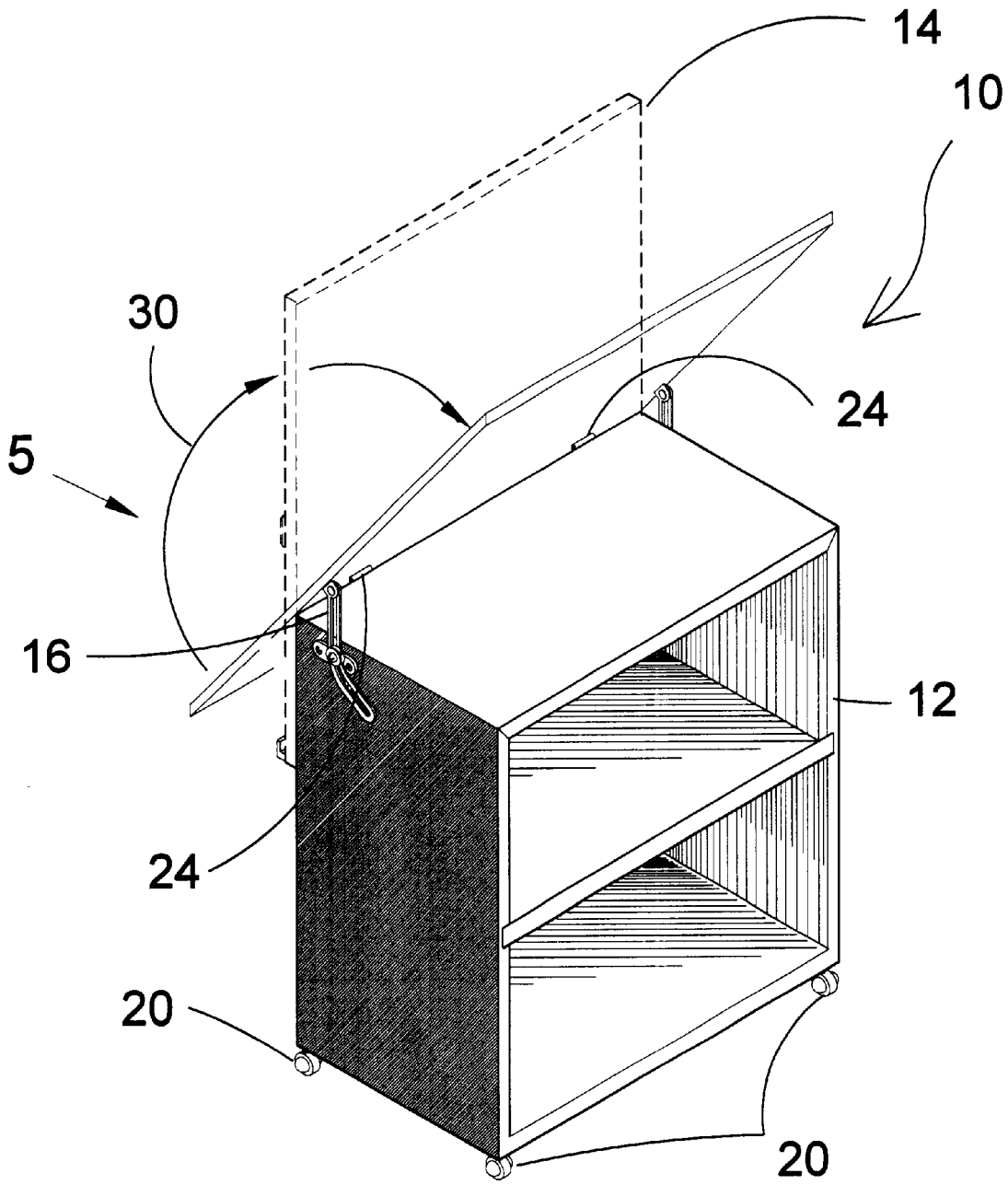
FIG. 4 is a front perspective view of the present invention. Shown is the easel being moved from a stored position to a user specified predetermined angle.

Turning to FIG. 4, shown therein is a front perspective view of the present invention 10. Shown with arrows 30 is the easel 14 being moved from a stored position to a user specified predetermined angle. Other elements previously disclosed are also shown.

Figure 5:
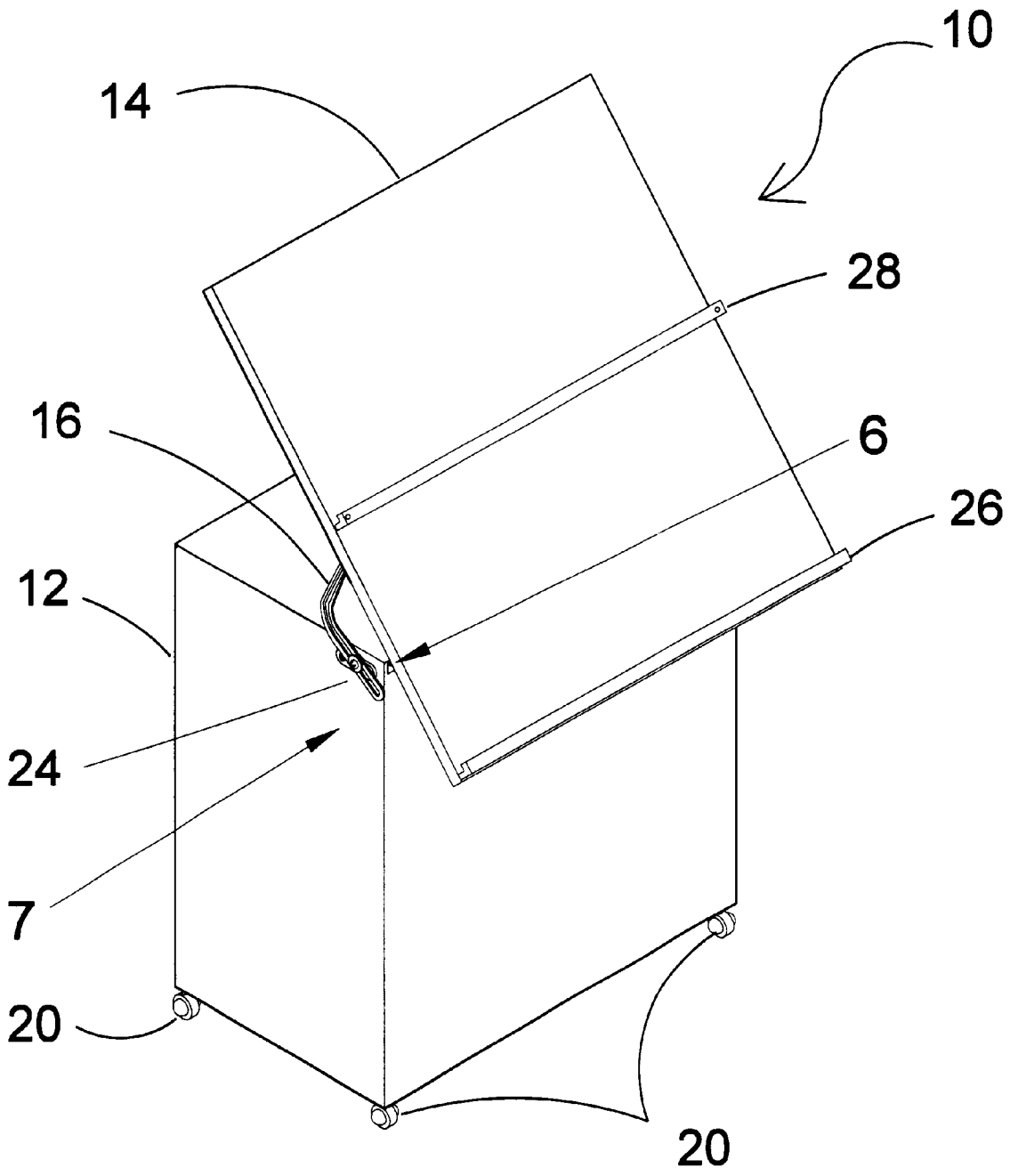
FIG. 5 is a rear perspective view of the present invention showing the easel positioned to a user specified predetermined angle.

Turning to FIG. 5, shown therein is a rear perspective view of the present invention 10 showing the easel 14 positioned to a user specified predetermined angle. Also shown is removable central rail 28 along with other elements previously disclosed.

Figure 6:
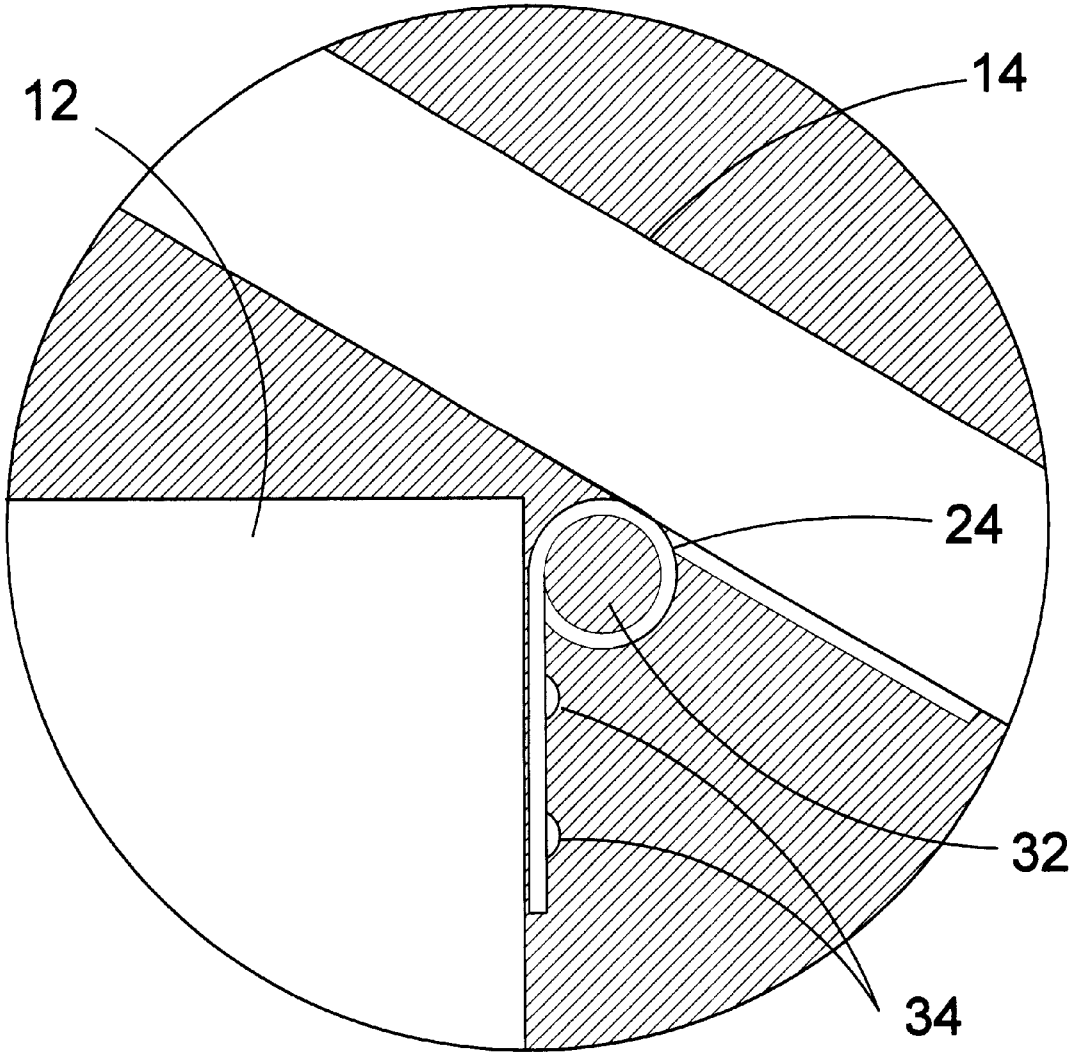
FIG. 6 is an enlarged view of the hinge connecting the easel to the bookcase element of the present invention.

Turning to FIG. 6, shown therein is an enlarged view of the hinge 24 connecting the easel 14 to the bookcase element 12 of the present invention. Hinge pin 32 is shown along with means of attachment 34 of the hinge 24 to bookcase 12.

Figure 7:
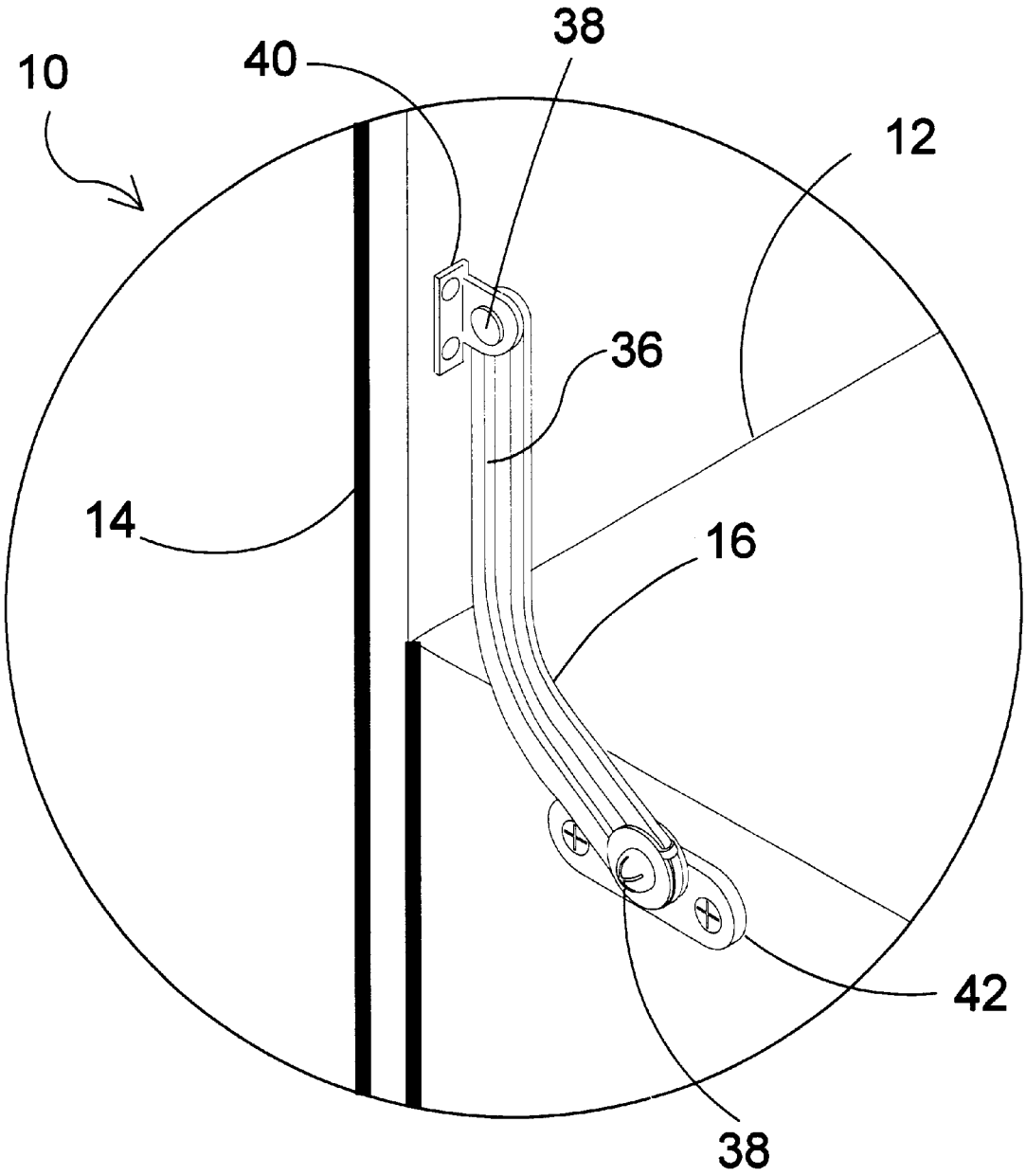
FIG. 7 is an enlarged view of the friction support element connecting the easel to the bookcase element of the present invention.

Turning to FIG. 7, shown therein is an enlarged view of the friction support element 16 connecting the easel 14 to the upper sides of bookcase element 12 of the present invention 10. The friction lid supports 16 is shown to be a curved element having a slot 36 centrally disposed therein running longitudinally along the support 16 for slidably receiving a means of attachment 38 which is connected to the easel 14 with means for attachment 40 and connected to the bookcase 12 with means of attachment 42.

Figure 8:
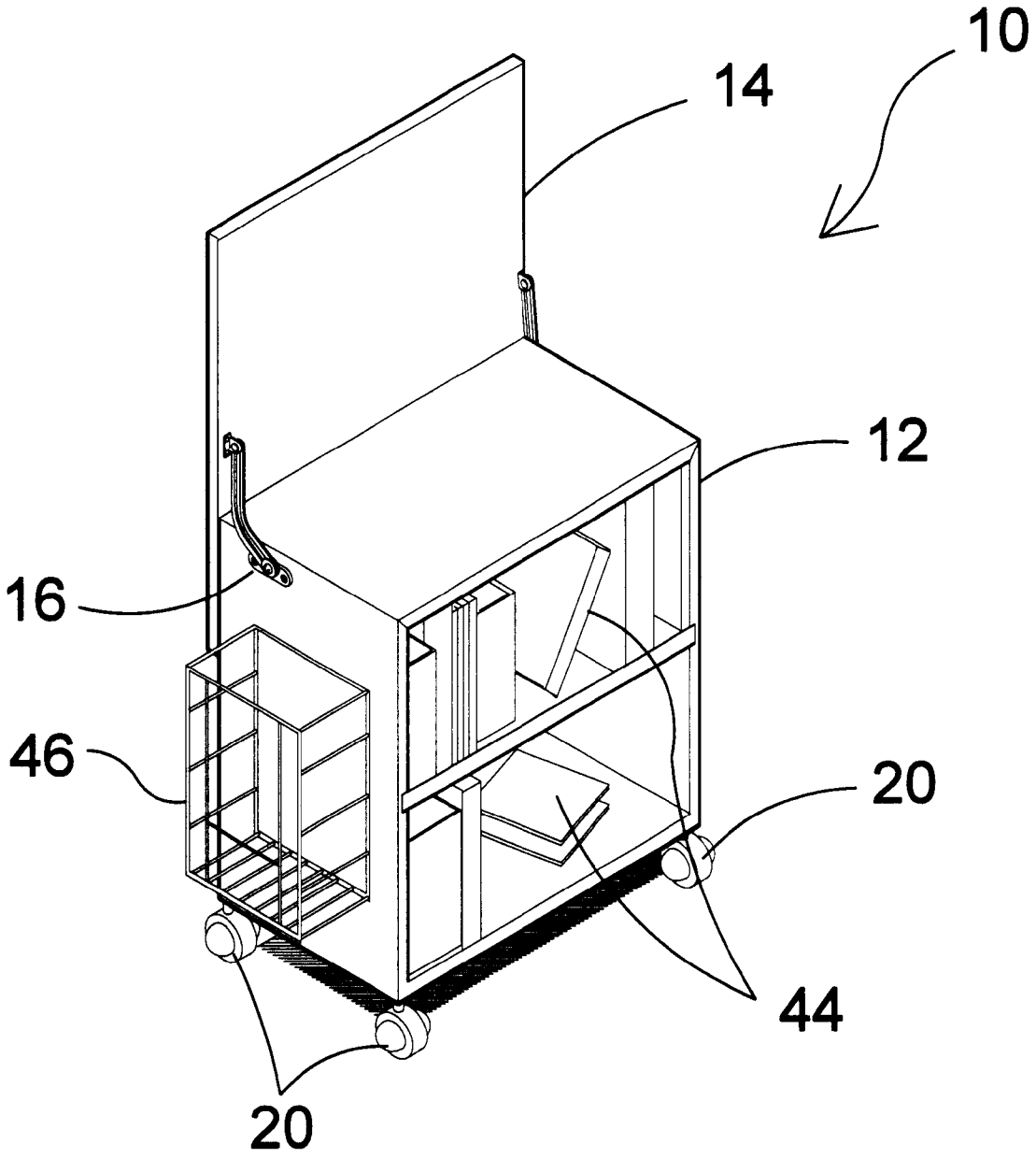
FIG. 8 is a front perspective view of the present invention. Shown is the bookcase element having a plurality of books therein. Also shown is the mobile workstation storage device having a plurality of casters. The easel element is in the stored position. There is also an optional storage unit attached to the side.

Turning to FIG. 8, shown therein is a front perspective view of the present invention 10. Shown is the bookcase element 12 having a plurality of books 44 therein. Also shown is the mobile workstation storage device having a plurality of casters 20. The easel element 14 is in the stored position and is adjustable using friction supports 16. There is also an optional basket storage unit 46 attached to the side of bookcase 12.

I claim:

1. A mobile work surface for use by a human having storage capability, said mobile work surface having storage capability and comprising:

a) a bookcase having a top, a bottom, a back, a pair of sides, and a plurality of horizontal shelves disposed therein;

b) a planar work surface disposed on said bookcase having a topside, an underside and a bottom edge;

c) a first means of rotatable attachment of said work surface to said back of said bookcase whereby said work surface is angularly adjustable about said bookcase;

d) a second means of movable attachment of said work surface to at least one of said sides of said bookcase whereby said work surface is angularly adjustable about said bookcase; and, e) a plurality of wheels disposed on said bottom of said bookcase, said bookcase being movable about upon said wheels, wherein said second means of movable attachment further comprises at least one friction support member and said friction support member is curved, said curved support member having a first end and a second end.

2. The apparatus of claim 1, wherein said first means of rotatable attachment further comprises a hinge.

3. The apparatus of claim 2, said hinge further comprising a hinge pin for connection of hinge elements.

4. The apparatus of claim 3, said hinge further comprising means for attachment of said hinge to said work surface.

5. The apparatus of claim 1, wherein said friction support member is elongated.

6. The apparatus of claim 5, wherein said friction support member has a centrally disposed slot therein.

7. The apparatus of claim 6, wherein said slot extends substantially the entire length of said friction support member.

8. The apparatus of claim 7, wherein said slot of said first end of said friction support member receives a means for slidable attachment to said planar work surface.

9. The apparatus of claim 8, wherein said slot of said second end of said friction support member receives a means for slidable attachment to one of said sides of said bookcase.

10. The apparatus of claim 8, wherein said means for slidable attachment attaches to said underside of said planar work surface.

11. The apparatus of claim 10, further comprising a first rail disposed on a bottom edge of said planar work surface.

12. The apparatus of claim 11, further comprising a second rail centrally disposed on said topside of said planar work surface.

13. The apparatus of claim 1, further comprising a storage basket disposed on one of said sides of said bookcase.

* * * * *